United States Patent [19]

Knoll

[11] 4,269,591

[45] May 26, 1981

[54] HEATER UNIT AND CONTAINER

[76] Inventor: William P. Knoll, 1326 N. Elm St., Fargo, N. Dak. 58102

[21] Appl. No.: 944,357

[22] Filed: Sep. 21, 1978

Related U.S. Application Data

[63] Continuation of Ser. No. 794,083, May 5, 1977, abandoned.

[51] Int. Cl.[3] ..... F23D 3/04; F23D 31/18

[52] U.S. Cl. ..... 431/312; 431/324

[58] Field of Search ..... 431/310, 312, 313, 315, 431/316, 320, 324; 220/308

[56] References Cited

U.S. PATENT DOCUMENTS

| | | | |
|---|---|---|---|
| 35,533 | 6/1862 | Merrill | 431/310 |
| 44,441 | 9/1864 | Neilson | 431/312 |
| 76,653 | 4/1868 | Osborn | 431/313 |
| 214,774 | 4/1879 | Hawley | 431/312 |
| 241,418 | 5/1881 | Requa | 431/312 |
| 241,670 | 5/1881 | Kennedy | 431/324 |
| 439,656 | 11/1890 | Hayes | 431/324 |
| 517,676 | 4/1894 | Atwood | 431/324 |
| 1,276,417 | 8/1918 | Rolfes | 431/310 |
| 1,841,364 | 1/1932 | Currie | 431/310 |
| 2,121,903 | 6/1938 | Currie | 431/324 X |
| 2,138,128 | 11/1938 | White | 431/324 X |
| 2,250,198 | 7/1941 | Hutt | 431/324 X |
| 3,792,797 | 2/1974 | Mrusek et al. | 220/308 |
| 3,799,731 | 3/1974 | Novak | 431/313 |
| 3,905,754 | 9/1975 | Maddestra et al. | 431/310 X |

FOREIGN PATENT DOCUMENTS

| | | | |
|---|---|---|---|
| 144767 | 7/1950 | Australia | 220/308 |
| 771738 | 10/1934 | France | 431/324 |
| 507014 | 6/1939 | United Kingdom | 220/60 R |

OTHER PUBLICATIONS

*Camping Journal,* Aug./Sep. 1978, pp. 46 & 57, "Wonder Stoves".

*Primary Examiner*—Carroll B. Dority, Jr.
*Assistant Examiner*—Randall L. Green
*Attorney, Agent, or Firm*—Burd, Bartz & Gutenkauf

[57] ABSTRACT

A heater unit usable with a container for storing inflammable liquid fuel to burn the fuel in a controlled manner. The heater unit has a cylindrical cup-shaped housing having an annular side wall and bottom wall. An upright tubular member attached to the bottom wall carries an elongated wick adapted to extend into the fuel in the container. A wick adjusting mechanism rotatably mounted on the side wall of the housing operates to adjust the position of the wick to control the flame at the upper end of the wick. A collar on the lower end of the tubular member is releasably mounted on the top of the container.

13 Claims, 14 Drawing Figures

HEATER UNIT AND CONTAINER

This application is a continuation of U.S. application Ser. No. 794,083 filed May 5, 1977, abandoned.

BACKGROUND OF THE INVENTION

Portable heaters and hand warmers are used as a source of heat. These heaters have fuel reservoirs, combustion chambers and means for conveying the fuel from the reservoirs to the combustion chambers. Similar structures are used in coal oil stoves and oil lamps. These structures are not adapted to be transported around in the trunks and tool boxes of motor vehicles. They are not connectable to conventional containers or cans, as each reservoir has special structure for accommodating the combustion chamber structure.

SUMMARY OF THE INVENTION

The invention is directed to a portable heater unit mountable on a container used to store an inflammable liquid fuel. The container is a conventional container having a neck surrounding an opening providing a passage into the container. The neck has a holding ring or threads adapted to accommodate a closure member or cap. The heater unit has a housing surrounding a heating or combustion chamber. The housing has a generally cup shape and is formed by an upright annular side wall secured to a bottom wall. An upright tubular member is attached to the center portion of the bottom wall. The tubular member has a first portion which projects up into the combustion chamber and a second portion which projects downwardly from the bottom wall. An elongated cylindrical wick is located in the tubular member. The wick is mounted in a tight sliding fit relationship with respect to the tubular member so that it can be longitudinally adjusted. The wick has an elongated lower end adapted to extend into the container whereby the liquid fuel is transported by capillary action through the wick to the upper end of the wick. A connector means is secured to the lower end or second portion of the tubular member. The connector means includes a collar having means operable to releasably coact with the holding means of the container to mount the heater unit on the container. In one form, the collar has a snap-on means operable to snap on to an outwardly directed ring on the top of the container. The snap-on means includes an inwardly directed annular rib and an annular pocket. A seal, as an O-ring, is located in the pocket. In use, the rib snaps over the ring on the container and holds the seal in tight sealing engagement with the top annular surface of the container top. In another form, the connecting means has internal threads adapted to turn on to a threaded neck of a conventional container.

An object of the invention is to provide a convenient and reliable source of heat for multi-purpose uses, including emergency use, camping use, and the like. A further object of the invention is to provide a heater unit adapted to be removably mounted on the top of a conventional container used to store an inflammable liquid. Another object of the invention is to provide a portable heater unit that is durable and easy to use and can be readily transported in an automobile or truck. These and other objects of the invention are embodied in the following detailed disclosure of an embodiment of the heater unit.

In the drawings

DESCRIPTION OF PREFERRED EMBODIMENTS

Figure 1:
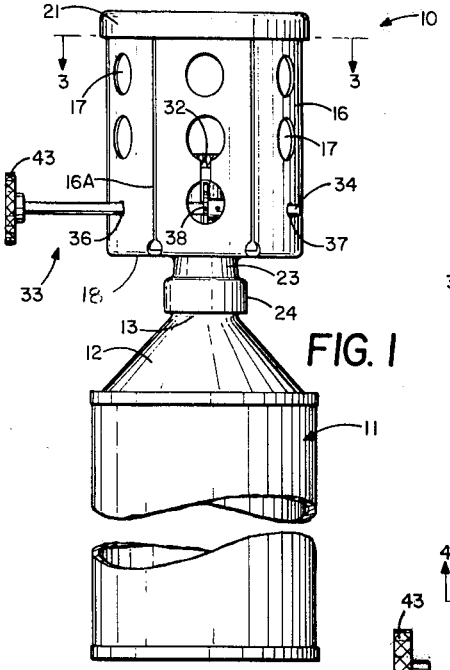
FIG. 1 is a side elevational view of a heater unit of the invention mounted on a foreshortened container storing a supply of inflammable liquid fuel.

Referring to FIGS. 1-8, there is shown a heater or burner unit indicated generally at 10 mounted on a container 11. Container 11 is preferably a metal can storing an inflammable liquid. The can may be a 12 fluid ounce metal structure. The liquid is a mixture of fluid which can contain a mixture of over 60% methanol. The container and liquid is a commercial gas dryer liquid product sold by Union Carbide Corp. under the trademark "PRIME" gas dryer or liquid product sold by Demert and Dougherty, Inc. sold under the trademark "HEET." Other liquids that are inflammable can be used as the liquid fuel. These liquids include but are not limited to alcohol, as ethanol alcohol and isopropanol alcohol.

Container 11 has an upwardly directed cone shaped top 12 joined to a central cylindrical neck 13. The top edge of neck 13 has an annular outwardly directed ring 14 adapted to accommodate a metal closure or cap (not shown).

Heater unit 10 has a cup-shaped housing comprising a cylindrical side wall 16 containing a plurality of vent holes 17. Side wall 16 is joined to a flat bottom wall 18. Side wall 16 and bottom wall 18 define a combustion chamber. Bottom wall 18 has a plurality of vent holes 19. Side wall 16 has a plurality, six, of upright arcuate segments separated with upright slits 16A. The lower end of each segment is joined to bottom wall 18. This allows side wall 16 and bottom wall 18 to be made from flat sheet metal.

Figure 2:
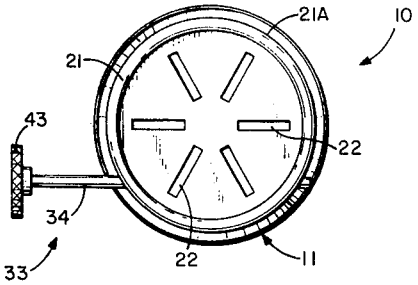
FIG. 2 is a top view of the heater unit of FIG. 1.
Figure 3:
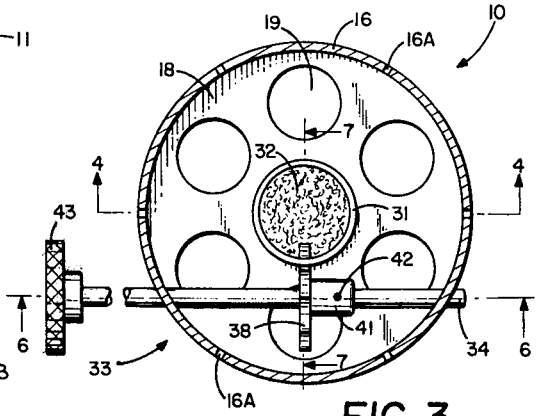
FIG. 3 is an enlarged sectional view taken along line 3—3 of FIG. 1.

As shown in FIG. 2, a removable cover 21 is mounted on the top of side wall 16. Cover 21 has a plurality of elongated openings or slots 22 which allow the heated air to flow through housing 16. Cover 21 has a downwardly directed annular flange or lip 21A which telescopes over the upper end of side wall 16. An upwardly directed annular lip 22B is integral with the outer peripheral edge of cover 21.

Figure 5:
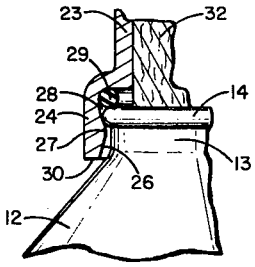
FIG. 5 is an enlarged sectional view of the connecting structure of the heater unit in assembled relation with the top of the container.

An elongated tubular member or neck 23 is secured to the center of bottom wall 18. An annular collar or sleeve 24 integral with the lower end of neck 23 is used to releasably mount heater unit 10 on container 11. Collar 24 has an inwardly inclined surface or ramp 26 forming a mouth around the inner surface of collar 24. An annular rib or inwardly directed continuous projection 27 separates ramp 26 from an annular pocket or recess 28. An annular seal or O-ring 29 is located in pocket 28. As shown in FIG. 5, collar 24 is mounted on top 12 and ring 14 of container 11. Ramp 26 has an inlet that is larger than the outside diameter of ring 14 thereby facilitating the alignment and snap-on mounting of collar 24 on ring 14. Rib 27 has a diameter slightly smaller than the outside diameter of ring 14 whereby rib 27 is in a tight or press fit relationship with ring 14. When collar 24 is mounted on ring 14, O-ring 29 is in sealing relationship with the top of ring 14. As shown in FIG. 5, ring 14 is located above rib 27 and extends into pocket 28 when collar 24 is fully mounted on ring 14. The outwardly inclined annular surface of collar 24 forming pocket 28 coacts with ring 14 to compress O-ring 29 between collar 24 and ring 14 to seal the collar 24 on ring 14. The lower end or surface 30 of collar 24 is located adjacent an annular portion of container top 12.

Figure 4:
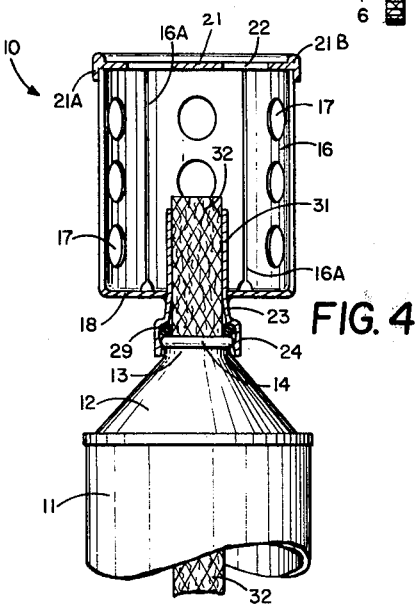
FIG. 4 is a reduced scale sectional view taken along the line 4—4 of FIG. 3.
Figure 6:
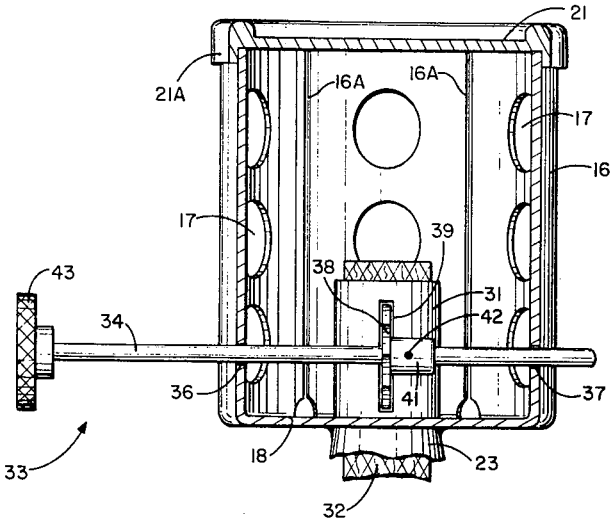
FIG. 6 is a sectional view taken along the line 6—6 of FIG. 3.
Figure 7:
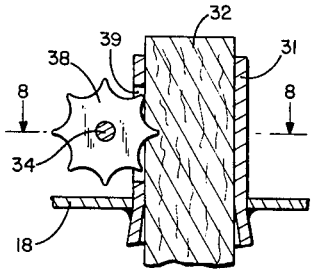
FIG. 7 is a sectional view taken along the line 7—7 of FIG. 3.
Figure 8:
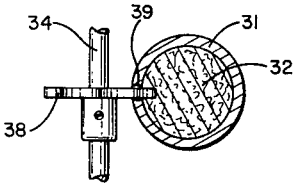
FIG. 8 is a sectional view taken along the line 8—8 of FIG. 7.

Tubular member 23 has an upright extension 31. As shown in FIGS. 4 and 6, extension 31 projects upwardly into the chamber surrounded by housing 16. An elongated wick 32 is located in tubular member 23. Wick 32 extends downwardly into the bottom of container 11. Wick 32 is made of a porous liquid absorbent material, as paper, wood, fibrous material or cotton. The material is a round cylindrical wick member. A network of strings or fibers are wrapped around the material to hold its cylindrical shape. Preferably, the wick is an elongated cylindrical member having a diameter of $\frac{5}{8}$ of an inch. The diameter of the wick is such that it fits in a tight compressive engagement with the inside surface of tubular member 31 and extends through the hole on top of container 11. The wick tightly engages the inside surface of the ring 14 forming the hole into container 11.

A wick adjusting mechanism indicated generally at 33 operates to adjust the longitudinal position of wick 32 in upright extension 31. Wick adjusting mechanism 33 has a transverse rod 34. As shown in FIG. 6, one end of rod 34 projects through a hole 36 in side wall 16. The opposite end of rod 34 extends through a hole 37 in side wall 16. A star wheel 38 is mounted on the mid-section of rod 34. Star wheel 38 has a sector that projects through an upright slot 39 in extension 31. Slot 39 is located in the side of extension 31 below the top edge of extension 31. The upper end of extension 31 functions as a heat dissipating portion which minimizes the burning of wick 32 through slot 39. Star wheel 38 has a hub 41 adapted to receive fastener 42, such as a set screw, for securing the star wheel 38 to rod 34. A cylindrical knob 43 mounted on the end of rod 34 is used to rotate the star wheel 38 to thereby adjust the elevation of wick 32 in extension 31.

Figure 9:
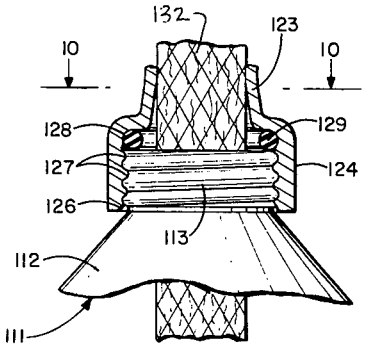
FIG. 9 is a sectional view of a modification of the connecting structure of the heater unit in assembled relation with the threaded top of a fuel container.
Figure 10:
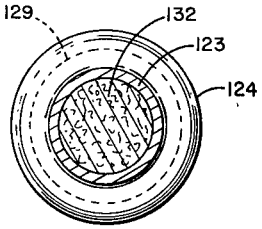
FIG. 10 is a sectional view taken along the line 10—10 of FIG. 9.
Figure 11:
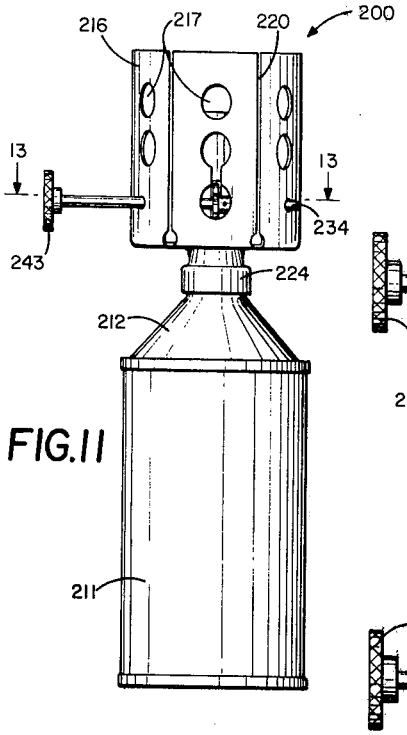
FIG. 11 is a side elevational view of another modification of the heater unit of the invention.

Referring to FIGS. 9 and 10, there is shown a modification of the coupling structure for mounting the heater unit on a container having a threaded neck. Container 111 has a cone shaped top 112 integral with an upwardly directed threaded cylindrical neck 113. The coupling structure of the heater unit has a tubular member 124 connected to tubular member 123 of the heater unit. Tubular member 123 is identical to tubular member 23, as shown in FIG. 1. Collar 124 has an inclined inside surface or ramp 126 that guides the collar 124 into axial alignment with neck 113. The inside of collar 124 above ramp 126 has internally directed threads 127 that cooperate with the threads on neck 113 to attach collar 124 to the neck. An annular pocket or recess 128 is located at the base of threads 127. A resilient annular seal or O-ring 129 is located in pocket 128. When collar 124 is threaded onto neck 113, seal 129 is located in sealing relation with the top of neck 113. An elongated cylindrical wick 132 extends through tubular extension 123, collar 124 and into the container 111.

In use, wick 32 is first moved through collar 24 into tubular member 23. Knob 43 is rotated to position the upper end of wick 32 slightly above the upper end of the end extension 41. The cap of container 11 is removed with a suitable cap remover. Wick 32 is moved through the opening in neck 13 of the container. The collar 24 is forced into a tight clamping relation with ring 14 by applying a downwardly directed force on housing 16. The incline ramp surface 26 guides the collar 24 until it snaps over rib 27. The resilient force of collar 24 forces the O-ring 29 in sealing relation with the top of ring 14. The heater unit is ignited with a flame from a match or lighter or the like. The size of the flame is adjusted by changing the amount of wick 32 that projects above the upper end of end extension 31.

A heater unit having the threaded connector 124 is mounted on a container 111 having a threaded neck such as neck 123. The wick 132 is first moved into tubular member 123. The cap is removed from neck 113 by rotating the cap. The long lower end of wick 123 is moved down into container 111. Collar 124 is then threaded onto neck 113 until the O-ring 129 is in a tight sealing relationship with the top of neck 113. The upper end of wick 132 is ignited with a suitable flame.

Referring to FIGS. 11–14, there is shown another modification of the heater or burner unit indicated generally at 200 mounted on a container 211 for storing inflammable liquids. Container 211 is identical in structure to container 11. The container 211 has an upwardly directed cone-shaped top 212. The upper end of top 212 has a cylindrical neck 213 terminating in an outwardly directed annular ring 214. A conventional metal closure or cap (not shown) is attached to ring 214 to close the opening in the top.

Unit 200 has an upright cup-shaped housing having an annular side wall 216 surrounding a combustion chamber. Wall 216 is made of a plurality of upright segments. Each segment has three vertically spaced holes 217. The segments are joined to a generally horizontal circular bottom wall 218. Bottom wall 218 has a plurality of holes 219. Upright vertical slots 220 separate the segments of the housing 216. The bottom wall 218 and housing 216 are formed from a single flat piece of metal. The segments are bent in an upright direction to form the cylindrical housing 216.

An elongated tubular member 223 extends through a central hole in bottom wall 218. Welds secure tubular member 213 to bottom wall 218. An enlarged cylindrical collar or sleeve 224 integral with the lower end of member 223 is used to snap on and mount heater unit 210 on container 211. Collar 224 is identical to the collar 24. The collar 224 has an inwardly inclined angular surface or ramp 226 forming a mouth on the inner surface of the collar. An angular rib or inwardly directed continuous projection 227 separates ramp 226 from an annular pocket or recess 228. An annular seal or O-ring 229 positioned in pocket 228 engages the top of ring 214 to seal the space between collar 224 and ring 214.

Figure 14:
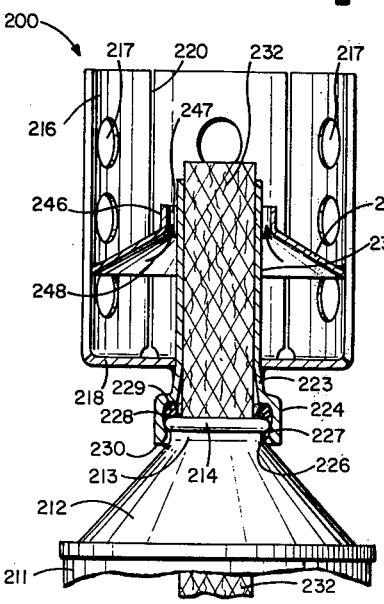
FIG. 14 is a sectional view taken along the line 14—14 of FIG. 12.

As shown in FIG. 14, collar 224 is mounted on the ring 214 thereby connecting the burner unit 200 with container 211. Ramp 226 has a diameter which is larger than the diameter of ring 214 thereby facilitating the alignment and coupling of collar 224 on the ring 214. Rib 227 has a diameter slightly smaller than the diameter of ring 214, whereby the rib 227 is in a tight or press fit relationship with ring 214. When collar 224 is mounted on ring 214, O-ring 229 is in sealing relationship with the top of ring 214. Rib 227 engages the lower portion of ring 214 thereby compressing the O-ring 229 on ring 214. The lower end or bottom 230 of collar 224 is spaced from the top 212 thereby allowing the collar 224 to be moved onto ring 214 without interference from top 212.

Tubular member 223 has an upright extension 231 extended upwardly into the house chamber. An elongated cylindrical wick 232 is located in tubular member 233. The lower end of wick 232 extends down into container 211. Wick 232 is made of porous absorbent material, as paper, cotton, or like materials. The absorbent material is wound to a cylindrical shape. A network of strings or fibers are wrapped around the material to hold the wick in its cylindrical shape. Wick 232 has a tight fit with the cylindrical inside wall of the tubular member 223.

Figure 13:
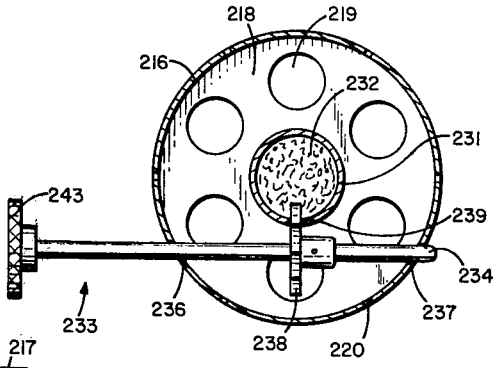
FIG. 13 is an enlarged sectional view taken along the line 13—13 of FIG. 11.

A wick adjusting mechanism indicated generally at 233 operates to move the wick into and out of the tubular member 223. The wick adjusting assembly, as shown in FIG. 13, has a transverse rod 234. Rod 234 extends to holes 236 and 237 in housing 216. A star wheel 238 is secured to the center of rod 234. A portion of star wheel 238 extends through an upright slot 239 in extension 231. A knob 243 secured to an outer end of rod 234 is used by an operator to rotate knob 243 to thereby turn star wheel 238. This longitudinally moves wick 232 in the extension 231.

Figure 12:
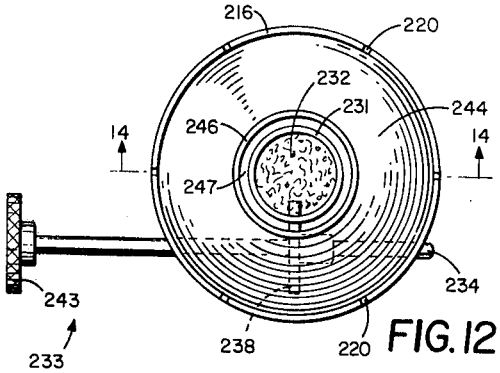
FIG. 12 is an enlarged top view of FIG. 11.

As shown in FIGS. 12 and 14, a generally cone-shaped baffle or shield 244 is located within housing 216. The baffle 244 has an upright cylindrical sleeve 246 surrounding the upper end of extension 231. Sleeve 246 is radially spaced from extension 231 forming therewith an angular passage or space 247. The air indicated by the arrow 248 moves through the passage 247 to retain the heat from the flame in the upper part of the housing chamber. Baffle 244 serves as a heat barrier which isolates the bottom wall 218 from the flame located at the top end of wick 232.

In use, the cap of container 211 is removed with a suitable opener or cap remover. Wick 232 is moved through the opening in the neck of the container 211. The wick has been previously inserted through the extension 231 and adjusted to a suitable height, with the adjusting mechanism 233. The collar 224 is then moved or snapped on to ring 214. This is accomplished by applying a downwardly directed force on the housing 216. The ramp 226 guides the collar relative to ring 214 until the lip 227 snaps over the ring 214. The O-ring 229 functions as a seal between the ring 214 and collar 224. A match or similar ignition unit is used to ignite the wick 232. The size of the flame is adjusted by changing the amount of wick 232 that projects above the upper end of the extension 231. A cover such as cover 21 can be used to close the top of housing 216.

The several heater units shown in FIGS. 1–14 and described herein can be used without the wick adjusting mechanism. The tubular extensions 31, 123 and 231 can have continuous walls or can be made with the slots for the star wheels. The wicks are adjusted when they are moved into the tubular extensions.

While there has been shown and described several preferred embodiments of the invention, it is understood that changes in materials, structures, and proportions and sizes may be made by those skilled in the art without departing from the invention. The invention is defined in the following claims.

The embodiments of the invention in which an exclusive property or privilege is claimed are defined as follows:

1. An apparatus for controlling combustion of an inflammable liquid fuel comprising: a container having a side wall, bottom, and a top defining a first chamber for storing an inflammable liquid fuel, said top having an annular outwardly directed continuous ring located around an opening in communication with the first chamber, said ring having an upper edge and a lower edge adapted to accommodate a cap for closing said opening, a heater unit releasably mounted on said ring to connect the heater unit to the container, said heater unit having a cup-shaped housing defining a second chamber, said housing having a bottom wall and a cylindrical side wall, said bottom wall having a center hole and at least one aperture, said side wall having a plurality of upright arcuate segments having substantially parallel edges defining elongated narrow slots extending the length of the housing side wall and separating adjacent segments, each segment having a lower portion joined to the bottom wall, at least one segment having at least one aperture, a tubular member extended through the hole in the bottom wall and secured to the bottom wall, said tubular member having a first portion extended into the second chamber surrounded by the housing side wall and a second portion extended below said bottom wall, a collar secured to the lower end of the second portion, said collar being spaced from the bottom wall, said collar having mount means for releasably connecting the collar to the ring, said mount means including an annular ramp forming a mouth, said ramp having an outer end, an inner end, and an annular surface inclined inwardly from the outer end to the inner end, said outer end of the ramp being larger than said ring, an annular rib joined to the inner end of the ramp, said annular rib being smaller than said ring and located in engagement with the lower edge of the ring, and an annular pocket above the rib, an annular seal located in the pocket and engageable with the upper edge of the ring to seal the collar on the ring, and an elongated wick located in the tubular member, said wick being extended through the tubular member and downwardly into the first chamber, said wick located in tight compressive engagement with the tubular member.

2. The apparatus of claim 1 wherein: said top is an upwardly directed cone-shaped member having an upwardly directed neck, said ring being attached to the neck.

3. The apparatus of claim 1 including: a cover mounted on top of the side walls, said cover having at least one opening to allow heated air to flow through the housing.

4. The apparatus of claim 3 wherein: the cover includes a downwardly directed lip located adjacent the upper end of the side wall.

5. The apparatus of claim 1 wherein: each segment has a plurality of apertures and said bottom wall has a plurality of apertures.

6. The apparatus of claim 1 including: an annular shield located in the second chamber and secured to the housing side wall below the upper end thereof, said shield having a central hole, said first portion of the tubular member extended through said hole.

7. The apparatus of claim 6 wherein: the central hole in the shield is larger than the tubular member whereby air flows upwardly through said hole.

8. The apparatus of claim 1 including: control means mounted on the housing operable to adjust the longitudinal position of the wick relative to the tubular member.

9. The apparatus of claim 8 wherein: said control means includes a rod rotatably mounted on the housing side wall, and wheel means mounted on the rod and engageable with the wick whereby rotation of the rod turns the wheel means to move the wick relative to the tubular member.

10. An apparatus for controlling combustion of an inflammable liquid fuel comprising: a container having a top and a first chamber for storing an inflammable liquid fuel, said top having an annular outwardly directed continuous ring located around an opening in communication with the first chamber, said ring having an upper edge and a lower edge adapted to accommodate a cap for closing said opening, a heater unit releasably mounted on said ring to connect the heater unit to the container, said heater unit having a perforated housing having a bottom wall and forming a second chamber, a tubular member secured to the bottom wall of the housing, said tubular member having a first portion extended into the second chamber and a second portion extended below said bottom wall, said housing extending above said tubular member, a collar secured to the lower end of the second portion, said collar being spaced from the bottom wall, said collar having mount means for releasably connecting the collar to the ring, said mount means including an annular ramp forming a mouth, said ramp having an outer end, an inner end, and an annular surface inclined inwardly from the outer end to the inner end, said outer end of the ramp being larger than said ring, an annular rib joined to the inner end of the ramp, said annular rib being smaller than said ring and located in engagement with the lower edge of the ring, and an annular pocket above the rib, an annular seal located in the pocket and engageable with the upper edge of the ring to seal the collar on the ring, and an elongated wick located in the tubular member, said wick being extended through the tubular member and downwardly into the first chamber, said wick located in tight compressive engagement with the tubular member.

11. The apparatus of claim 10 wherein: said top is an upwardly directed cone-shaped member having an upwardly directed neck, said ring being attached to the neck.

12. The apparatus of claim 10 including: an annular shield located in the second chamber and secured to the housing, said shield having a central hole, said first portion of the tubular member extended through said hole.

13. The apparatus of claim 12 wherein: the central hole in the shield is larger than the tubular member whereby air flows upwardly through said hole.

* * * * *